United States Patent [19]

Groome et al.

[11] 4,003,783

[45] Jan. 18, 1977

[54] METHOD FOR COMPACTING A NONWOVEN FABRIC IMPREGNATED WITH A THERMOPLASTIC BINDER

[75] Inventors: Ernest J. Groome, Covington, Va.; Henry L. Hamrick, Hartsdale, N.Y.

[73] Assignee: Clupak, Inc., New York, N.Y.

[22] Filed: Apr. 7, 1975

[21] Appl. No.: 565,823

Related U.S. Application Data

[63] Continuation-in-part of Ser. No. 394,993, Sept. 7, 1973, abandoned.

[52] U.S. Cl. ..... 162/168 R; 162/206; 162/361

[51] Int. Cl.[2] ..... D21H 5/24

[58] Field of Search ..... 162/206, 205, 361, 305, 162/111, 280, 168 R; 26/18.6

[56] References Cited

UNITED STATES PATENTS

| | | | |
|---|---|---|---|
| 3,011,545 | 12/1961 | Welsh et al. | 162/361 |
| 3,329,556 | 7/1967 | Mc Falls et al. | 162/206 X |
| 3,515,633 | 6/1970 | Futch, Jr. | 162/206 |
| 3,525,787 | 8/1970 | Mc Dermott | 162/206 X |
| 3,812,000 | 5/1974 | Salvucci, Jr. et al. | 162/168 R X |

*Primary Examiner*—Robert L. Lindsay, Jr.

*Assistant Examiner*—Richard V. Fisher

[57] ABSTRACT

A method for compacting a nonwoven fabric impregnated with a thermoplastic binder at a temperature higher than the softening temperature of the binder to improve hand and drape of the fabric. A bar compresses a relatively thick endless elastomeric belt against a steam heated drum so that a nip is formed therebetween. The nonwoven fabric is passed through the nip between the belt and the drum and thence onto the drum. The nonwoven fabric adheres frictionally to a stretched surface of the belt as it goes through the nip and is thereafter compacted by the belt as the belt unstretches onto the drum. Fibers of the fabric are crowded together, rearranged and crimped locally (all between the faces of the fabric) and more of the fibers of the fabric are caused to be oriented crosswise. To allow compacting at sufficiently high temperatures (160° – 280° F.) without sticking of the fabric to the drum due to the binder, as well as to obviate need for addition of release agents to the drum surface, the drum is lined with tetrafluoroethylene resin (available commercially as TEFLON, a trademark of Du Pont de Nemours & Co.).

2 Claims, 4 Drawing Figures

METHOD FOR COMPACTING A NONWOVEN FABRIC IMPREGNATED WITH A THERMOPLASTIC BINDER

CROSS REFERENCE

This is a continuation-in-part application with respect to our copending application Ser. No. 394,993 which was filed on Sept. 7, 1973, now abandoned.

BACKGROUND OF INVENTION

This invention relates to nonwoven fabrics that are formed of fibers bonded randomly to one another by small discrete particles of an added polymeric material at contacts between thermoplastic fibers by heat. These nonwoven fabrics have improved kinesiological properties over prior nonwoven fabrics made of the same materials.

Nonwoven fabrics have been limited in their applications by stiffness in simple bending and resistance to deformation under complex stresses such as those encountered in bodily movements. Consequently handle or feel of nonwoven fabrics is liable to be harsh and such fabrics generally do not drape well. Achievements of softness and draping properties (without substantial loss of strength) have been major obstacles to more extensive applications of nonwoven fabrics. Nonwoven fabrics usually are formed by laying loose fibers on a moving support, hence the fibers are guided in a direction of their lay to some extent by initial contact of ends of the fibers with the moving support and this initial contact generally causes them to lie largely in the direction of movement of the support, which would be the length of the fabric. Such fabrics when supported solely by a central area thereof tend to flex along an axis that is substantially parallel to the length of the fabric, the direction in which most of the fibers are oriented.

Considerable development work has been performed to improve nonwoven fabrics so as to make them soft to the feel and to impart to them greater kinesiological properties. With particular respect to kinesiological properties, emphasis has been placed on making the crosswise strengths more compatible with lengthwise strengths (while not substantially weakening the fabrics lengthwise). Nonwoven fabrics have been produced commercially which have hand and drape properties quite similar to woven fabrics, are relatively inexpensive to make, can be sterilized and are relatively quiet when flexed whereby said nonwoven fabrics are suitable for use in expendable garments, diaper skins, skins for sanitary napkins and the like. These results have been achieved in the prior art by subjecting such nonwoven fabrics to compacting forces between faces of the fabrics, which forces crowd, flex and rearrange the fibers together lengthwise with stretches of fibers between their point of bonding to other fibers. Also these forces locally flex, crimp and bend the fibers crosswise. During such compacting, pressure also is applied to opposite faces of the fabrics adequate to prevent creping of the fabrics.

In essential features known apparatus suitable for achieving the desired compacting forces include a heated cylindrical drum mounted for rotation on its axis. A relatively thick endless belt of an elastomeric material passes between one peripheral sector of the drum and a compactor bar and thence onto the drum. The compactor bar engages the belt approximately radially of the drum until a suitable nip between the belt and the drum is established. The belt on or near its surface that engages the bar has a cord reinforcement that restricts lengthwise stretching of the belt along the reinforced face, but permits local stretching of the other face that abuts the drum. The nonwoven fabric is fed through the nip between the belt and the drum thence onto the drum for some distance around its periphery and then the nonwoven fabric is removed from contact with both the drum and the belt.

In passing through the nip between the belt and the drum, the nonwoven fabric adheres frictionally to the stretched surface of the belt passing the nip, and as the elastic belt surface unstretches in passing onto the drum, the fabric is compacted lengthwise. Because pressure on the fabric (which is substantially normal to its faces) restricts the fabric from becoming materially thicker due to its lengthwise compaction, the fibers are crowded together crosswise, rearranged and crimped locally all within the space between the faces of the fabric. This compaction causes more of the fibers to be oriented crosswise and increases crosswise tensile strength of the fabric.

In implementing such compacting on a commercial scale, it has been found that for some nonwoven fabrics hand and drape improvements require relatively high temperatures of operation of the drum in the order of 160° to 280° F. (71° to 138° C.). When drum temperatures are not sufficiently high, some nonwoven fabrics are found not to compact satisfactorily. However with high temperatures, the fabrics can stick to the drum resulting in damage to the fabrics and/or poor or no compaction. This sticking is especially troublesome in nonwoven fabrics which contain heat sealable thermoplastic binders such as are used generally in diaper skins, skins for sanitary napkins and the like. Steam sprays have been used to provide lubrication on the drum surface, but such steam sprays have not proven to be completely satisfactory. Desirable high operating temperatures have been achieved by use of release agent such as silicone oils and the like, but these release agents are expensive, they inhibit heat sealing properties of polymeric materials and they may be quite unacceptable in the resulting nonwoven fabric.

BRIEF STATEMENT OF INVENTION

The present invention overcomes difficulties of operating at sufficiently high temperatures to compact nonwoven fabrics containing thermoplastic binders satisfactorily without need for any release agents. The crux of the present invention is to line the heated drum with a polytetrafluoroethylene resin (available commercially as TEFLON, a trademark of Du Pont de Nemours & Co.).

Accordingly one object of this invention is to achieve superior compacting of nonwoven fabrics containing thermoplastic binders whereby hand of the fabrics is improved.

Another object of this invention is to achieve more isotropic properties of nonwoven fabrics whereby their drapes and crosswise strengths are improved.

Still another object of this invention is to permit operation of compacting apparatus at higher temperatures than had been feasible according to the prior art.

Still another object of this invention is to avoid sticking of nonwoven fabrics to drums of compacting apparatus due to thermoplastic binders in the fabrics.

Still another object of this invention is to obviate need for release agents in compacting nonwoven fabrics.

Still another object of this invention is to promote efficiency of compacting nonwoven fabrics.

Still another object of this invention is to produce nonwoven fabrics having superior absorbency and which are suitable otherwise for further processing and/or conversion.

BRIEF DESCRIPTION OF DRAWINGS

Other objects and advantages will appear from the following description of a preferred embodiment of apparatus for compacting nonwoven fabrics viewed in conjunction with an accompanying drawing and novel features will be pointed out particularly in claims appended hereto. In the accompanying drawing:

DETAILED DESCRIPTION OF PREFERRED EMBODIMENT

In accordance with this invention, a nonwoven fabric formed of layed fibers that are bonded randomly to one another at intervals by fusion or by discrete added particles of a polymeric material, is subjected to compacting forces entirely between its faces in a direction parallel to a lengthwise dimension of the fabric that compact, crowd, flex and rearrange the fibers together in such direction of compaction with stretches of fibers between their points of bonding to other fibers, also locally flexed, crimped or bent laterally of their lengths. During such subjection to compaction forces, pressure is applied also to the opposite faces of the fabric normal to such faces, adequate to inhibit or prevent creping of the fabric.

Figure 1:
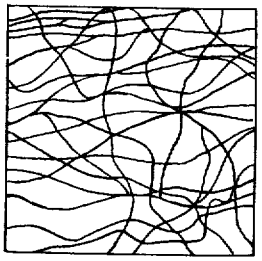
FIG. 1 PRIOR ART
FIG. 1 is an illustration of a fiber arrangement in a local area of a typical nonwoven fabric before treatment in accordance with this invention.
Figure 2:
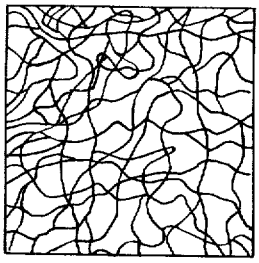
FIG. 2 is a similar illustration to FIG. 1 of the fiber arrangement of a local area of such nonwoven fabric after it has been treated in accordance with this invention.
Figure 3:
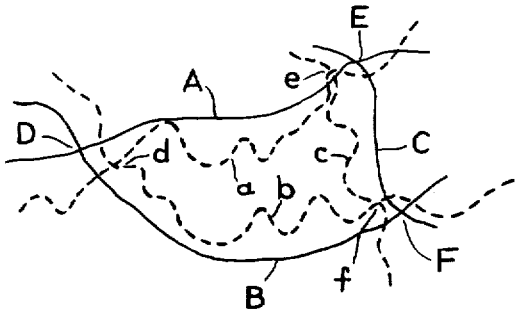
FIG. 3 is a schematic illustration on a much larger scale than that of FIGS. 1 and 2 to demonstrate some changes in the fiber relationships of nonwoven fabric before and after treatment in accordance with this invention.
Figure 4:
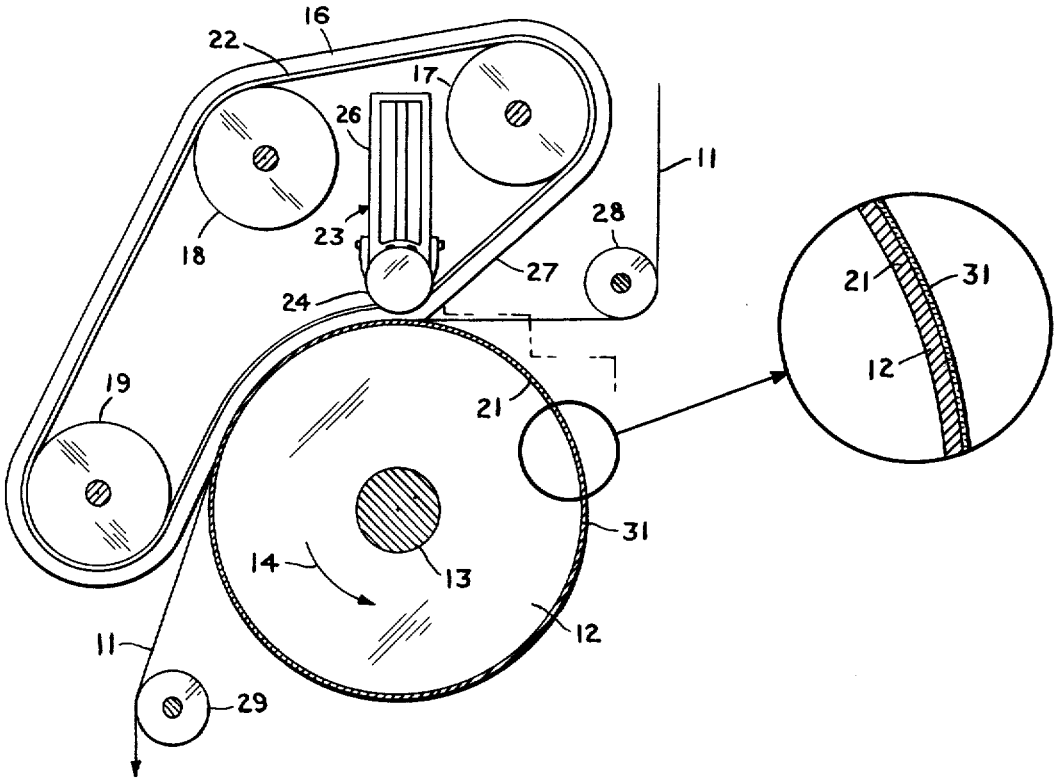
FIG. 4 is a schematic view partly in section showing a compacting apparatus capable of carrying out this invention.

FIG. 1 illustrates a small portion of a nonwoven fabric before compaction in accordance with this invention. It will be noted that the fibers of this fabric lie predominantly in one direction which likely would be the direction in which the support moved as the fibers were deposited thereon. FIG. 2 is a small portion of such a fabric after it has passed through apparatus such as that shown in FIG. 4 during which the fibers were compacted and crowded together in a direction lengthwise of the fabric and also flexed and rearranged locally. It should be noted that the treatment in an apparatus such as shown in FIG. 4 has increased the number of crosswise disposed fibers in this area, so that the fibers now offer about as much resistance to tensile stresses in the crosswise direction as the lengthwise direction, and more fiber stretches now are disposed crosswise of the length of the fabric. It will be noted also that the fibers, particularly those disposed to extend generally lengthwise of the fabric, have also between points of bonding to one another been bent locally, flexed or crimped in their crosswise direction. This concept is demonstrated more clearly schematically in FIG. 3 where full lines represent a few fibers A, B and C bonded together by discrete particles of resin where they cross one another at D, E and F. Dashlines *a*, *b*, and *c* represent positions and shapes of the fibers A, B and C respectivey after the fabric has been compacted and its fibers rearranged in accordance with this invention. Assuming that bond point D remains relatively stationary, it will be noted that bond point E has moved to position *e* and point F has moved to position *f*. This movement shortens the distance between the bond point D and the new position *e* and *f* of the bond points E and F and hence the fibers A and B are bent, flexed or collapsed randomly laterally upon themselves as shown by the dash lines *a* and *b*. The bond points E and F also are moved closer together to the positions *e* and *f*, hence fiber C is also flexed or bent sideways upon itself locally as shown by the dash line C.

The nonwoven fabric web 11 is shown in FIG. 4 to be supplied from some preceding operation. As in the disclosure of Cluett U.S. Pat. No. 2,624,245 according to which this apparatus is designed, the compacting apparatus includes a steam heated drum 12 of substantial diameter. The drum 12 is of sturdy construction and is mounted on a shaft 13 which is driven rotatively by a suitable means (shown as arrow 14). A thick blanket 16 made of a resilient elastomeric material (such as rubber) is mounted on three rolls 17, 18 and 19 which are arranged to tension the blanket 16. The blanket 16 has a run which travels on a segment 21 of the drum 12. The blanket 16 may have a Shore Durometer hardness of between 40 and 80 depending upon its application and is provided with a nonstretchable backing of cord 22. The blanket 16 is driven by the drum 12. The rotary parts thus far described all are mounted in rigid side frame members (not shown), which are disposed outside the lateral bounds of the nonwoven web 11 and the blanket 16.

Typically a bar 23 extends across the machine through substantially the full length of the drum 12 being supported at its ends. The bar 23 comprises a thick walled but hollow metal cylinder 24 and a rigid beam 26. The cylinder 24 and the beam 26 are desirably of steel or steel alloy and are of substantial strength and rigidity. The cylinder 24 is of small diameter, but the total depth of the bar 23, as constituted by the cylinder 24 and the beam 26, is considerably greater than the diameter of the cylinder 24. The cylinder 24 is disposed to engage the back of the blanket 16 and to press the blanket 16 radially against the drum 12 to form a uniform nip for the nonwoven web 11. This is the nip in which the compacting of the web 11 of nonwoven fabric takes place.

Means for provided for applying an evenly distributed pressure across the width of the bar 23 and for causing thereby a pressure which is distributed evenly across the blanket 16 from edge to edge thereof. It is important that evenly distributed pressure be applied to the bar 23. It is important also, however, to be able to maintain the pressure at any predetermined level throughout a wide pressure range. Therefore, a dependable hydraulic or pneumatic pressure source (not shown) is provided, capable of maintaining any desired pressure throughout a wide range. Because devices of this character are well known, no detailed showing and description are thought necessary. Feed roller 28 and exit roller 29 are also provided.

As has been pointed out sticking of fibers of the nonwoven fabric web 11 to the drum 12 is avoided by polytetrafluoroethylene resin layer 31 (TEFLON is the trademark of Du Pont de Nemours & Co. for polytetrafluoroethylene resin). It is desirable to operate the drum 12 at from 160° to 280° F. so that adequate compacting of the nonwoven fabric web 11 is assured. The polytetrafluoroethylene resin coating 31 eliminates need for release agents (such as silicone oils) being applied to the drum 12. A trial has been run on 13 inch laboratory compacting apparatus such as that here disclosed to determine benefits derived from a polytetrafluoroethylene resin covering on the drum 12 when processing the nonwoven web 11 which contains a thermoplastic binder. The sheet composition and compactor conditions are given in the following table. With a TEFLON 31 covered drum 12, the nonwoven fabric web 11 was processed at 250° F. without difficulty. After removing the TEFLON 31 it was necessary to reduce the drum 12 temperature to 150° F. before the nonwoven fabric web 11 could be compacted. This temperature reduction was necessitated because binders in the nonwoven fabric web 11 stuck to the drum 12. Even at this reduced temperature, the nonwoven fabric web 11 could not be compacted when it was rewetted to a 10% water content by means of a steam shower. In order to process a moistened sheet, it was necessary to reduce the temperature of the drum 12 to 120° F. Tensile strength, elongation, tensile energy absorption and stiffness were all improved by operating the apparatus at the higher temperature (250° F.) made possible by the TEFLON covering 31 on the drum 12.

TABLE

| Drum Temp. ° F. | Compactor Driven Surface | Sheet Moisture (%) | Tensile (No. /in) | Elongation (%) | Tear (gm) | TEA** (Ft No./Ft²) | Stiffness (Drape Flex inches) |
|---|---|---|---|---|---|---|---|
| 250° F. | TEFLON | 6 | 9.2 | 25.8 | 827 | 12.1 | 1.7 |
| | | 10 | 9.5 | 32.5 | 810 | 13.7 | 1.9 |
| | Chrome | 6* | * | * | * | * | * |
| | | 10* | * | * | * | * | * |
| 150° F. | Chrome | 6 | 8.8 | 19.2 | 819 | 9.5 | 2.5 |
| | | 10* | * | * | * | * | * |
| 120° F. | Chrome | 6 | 8.4 | 14.7 | 821 | 8.6 | 2.8 |
| | | 10 | 8.5 | 18.1 | 840 | 9.1 | 2.8 |
| | No Compaction | — | 9.4 | 9.1 | 587 | 7.1 | 4.4 |

Compactor: 12% nip, 60 pound per lineal inch blanket tension, 50 Shore A Durometer blanket hardness.
Sheet: 34 No./3000 ft², 50% Hardwood Sulfite, 20% Nylon 66, 30% Polyvinyl alcohol.
*Sheet stuck to compactor drum - no compaction
**TEA means tensile energy absorption.

It will be understood by those familiar with compacting nonwoven fabric webs that various deviations may be made from the foregoing detailed description without departing from the main theme of invention set forth in the following claims. It will be understood further that the example set forth above is merely illustrative and in no way limiting.

We claim:

1. In a method of treating a preformed, non-woven fabric web having staple textile fibers randomly bonded together at contact points between said fibers by a thermoplastic binder having a predetermined softening temperature, including the steps of:

a. moisture conditioning said web;

b. continuously moving said conditioned web to the nip of a compactor means, the nip including a stretched surface of a moving elastic belt and a peripheral segment of a rotating, heated drum having a polished metal surface, the binder being normally adherent to the metal surface when heated in excess of its softening temperature;

c. compacting the web by the contraction of said elastic surface just beyond the nip while the web is confined between the belt and the drum periphery, whereby due to the frictional adherence between the web and the elastic surface, said web is caused to slip relatively to the drum periphery and to be contracted and compressed lengthwise thereby causing the fibers to be rearranged and locally flexed and crimped in upon themselves between the points of bonding with one another;

the improvement comprising:

d. coating the drum surface with a solid film of polytetrafluoroethylene resin prior to the compaction step; and e. heating the surface of the drum in excess of the softening temperature of the binder during compaction, whereby the fabric web can be compacted while the temperature of the drum is in excess of the softening temperature of the binder without the binder and the web adhering to the drum surface, the web having improved handle and drape qualities imparted thereto by such treatment.

2. The method of claim 1, further wherein the binder is polyvinyl alcohol and furthermore wherein the compaction step c) is carried out with the drum temperature at from 160° to 280° F.

* * * * *